United States Patent [19]

Tomarin

[11] Patent Number: 4,637,942

[45] Date of Patent: Jan. 20, 1987

[54] SYNTHETIC GRASS PLAYING FIELD SURFACE

[75] Inventor: Seymour A. Tomarin, St. Catharines, Canada

[73] Assignee: Tecsyn Canada Limited, St. Catharines, Canada

[21] Appl. No.: 779,322

[22] Filed: Sep. 23, 1985

[51] Int. Cl.[4] ..... A01N 3/00

[52] U.S. Cl. ..... 428/17; 428/95; 428/96

[58] Field of Search ..... 428/17, 95, 96

[56] References Cited

U.S. PATENT DOCUMENTS

| | | | |
|---|---|---|---|
| 4,010,302 | 3/1977 | Anderson et al. | 428/95 |
| 4,497,853 | 2/1985 | Tomarin | 428/17 |
| 4,535,021 | 8/1985 | Friedrich | 428/95 X |

*Primary Examiner*—Alexander S. Thomas
*Attorney, Agent, or Firm*—Cullen, Sloman, Cantor, Grauer, Scott and Rutherford

[57] ABSTRACT

A playing field surface for active running and body contact type sports, such as football and the like, is formed of a stabilized, flat base surface covered by an underpad, over which is laid a synthetic pile fiber carpet. A covering of sand-like granules is applied upon the carpet to substantially fill the spaces between the fibers. The underpad is made of reclaimed rubber, sliver-like small particles which are bonded together into a thick, water pervious mat. The lower surface of the underpad is formed with widely and regularly spaced apart, dimple-like indentations and downwardly extending, rounded hills that contact the base surface. The hills are separated by rounded indented ridges which are of a lesser depth than the indentations. Each of the indentations is surrounded by a number of hills and ridges to provide resilient dome-like, interconnected, downwardly open pockets in the bottom surface of the underpad. The piles are formed of U-shaped, double bent fibers having bights looped through and extending downwardly beneath a carpet base sheet to form numerous welts. The welts are aligned in parallel serpentine rows and dig into and frictionally interlock with the particles forming the upper surface of the underpad. The playing field surface provides good support for lateral foot movements and resiliently absorbs and disperses the forces of foot and body impacts.

13 Claims, 7 Drawing Figures

SYNTHETIC GRASS PLAYING FIELD SURFACE

BACKGROUND OF THE INVENTION

This invention relates to a simulated grass playing field surface that is particularly useful for running and body contact types of athletic games, such as football, soccer and the like. Such playing surfaces generally comprise a pile carpet having synthetic grass-like plastic fibers which are positioned upon a stabilized base support surface. Examples of this general type of game surface are disclosed in my prior U.S. Pat. Nos. 4,336,286 issued June 22, 1982, 4,396,653 issued Aug. 2, 1983 and 4,497,853 issued Feb. 5, 1985.

The game playing surfaces disclosed in the foregoing patents include a granular covering over the synthetic grass-like fiber carpet which covers the carpet base sheet and a substantial part of the height of the fibers. Thus, the composite playing surface simulates, reasonably closely, a natural grass or natural turf surface.

In many sports where there is hard running, with frequent directional change or body twisting movement by the players and where there is frequent ground contact by the players, such as in the tackling common to football, it is desirable to have a game playing surface which resiliently absorbs and softens impacts and permits lateral or twisting foot movements without binding the players foot. In addition, the surface must have ball rebound characteristics which are as close as possible to a natural grass or turf playing surface.

Thus, the present invention relates to an improved playing surface which, while useful for many different sports, is particularly adapted for vigorous types of sports with frequent anticipated ground contact by the players.

SUMMARY OF INVENTION

The invention herein relates to a synthetic grass playing field surface of the type having simulated grass pile carpet laid over a stabilized base support surface, wherein a thick underpad is arranged between the bottom of the carpet and the upper surface of the support base. The underpad is preferably formed of irregularly shaped, relatively small size rubber-like particles which are bonded together to form a resilient, dense mass which is water pervious for drainage. The upper surface of the underpad is flat. But, the lower surface is provided with relief-type indentations that form large, widely spaced apart dimples surrounded by rounded hills interconnected by valley-like ridges. Thus, the bottom surface of the underpad provides dome-like pockets that open into each other and are covered by the portions of the base surface which they overlap.

Preferably, the carpet is formed of fibers which are made of double bent, U-shaped strands which are looped through a fibrous carpet base sheet. The bights of the fibers extend beneath the lower surface of the carpet base sheet to form welts. These welts are aligned in serpentine or sine-like curved rows which are parallel and spaced apart from each other. The welts in each row are parallel to and spaced apart a small distance from their next adjacent welts so that the welts dig into and frictionally interlock with the particles forming the upper surface of the underpad.

The composite arrangement of the fibers, the granule filling, the interlocking between the welts and upper surface of the underpad, and the underpad construction with its lower indented surface formation provides substantial impact force absorbing and dispersing characteristics. It also provides good foot support for lateral and twisting foot movements. Yet this system is relatively inexpensive, rugged and durable so as to handle the heavy wear and tear of hard running, body contact types of sporting activities.

One major object of this invention is to provide a playing field surface which provides enhanced resiliency and impact force absorption and dispersion characteristics, but is relatively simple and inexpensive to construct and to maintain. Another object is to provide such a playing surface which is sufficiently sturdy to handle the rough beating and dragging of hard running, foot body contact with the playing surface, tackling forces and the like.

These and other objects and advantages of this invention will become apparent upon reading the following description, of which the attached drawings form a part.

DETAILED DESCRIPTION

Figure 1:
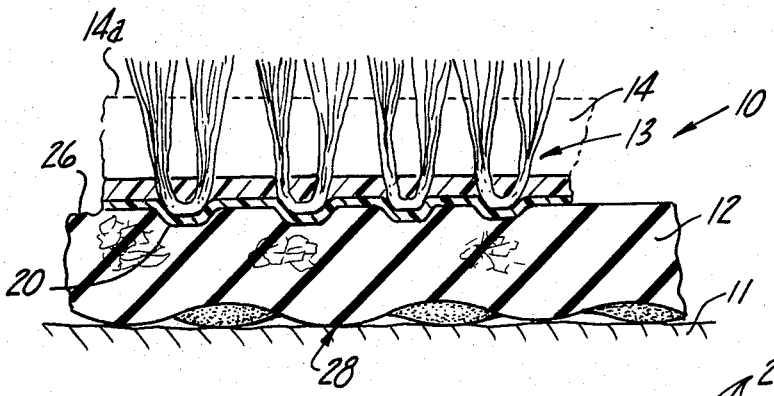
FIG. 1 is a cross sectional, elevational view of a fragment of the playing surface herein.

Referring to the drawings, the playing field surface 10 comprises a stabilized base or support surface 11 covered by an underpad 12, upon which a synthetic grass-like, pile carpet is laid. A sand-like granule filling 14 in-fills the carpet to a substantial depth as indicated by the dotted line **14*a* in FIG. 1**.

The carpet has a carpet base sheet 15 which is preferably formed of a woven sheet of suitable plastic material such as polypropylene, nylon or the like commercially available materials. Fibers 16 form the piles of the carpet. These fibers are made of U-shaped, double bent strands 17 whose bights 18 are looped through the carpet base sheet. The bight portions extending beneath the carpet base sheet form short welts 20. These welts are aligned into parallel, undulating, sinusoidal curved rows 21. Each welt extends transversely to its row.

The adjacent welts 20 in each row are parallel and slightly offset relative to each other. Also, they are closely spaced together, as for example, a ⅛ inch spacing. However, the rows themselves are spaced further apart, as for example, ¼ inch apart or about double or more the spacing between the individual welts.

The bottom surface of the carpet base sheet may be coated with a suitable plastic coating 23, such as of urethane or the like commercially available plastic material. Preferably, such material has a rough or high frictional characteristic, like a rubber surface. Thus, the coating covers the bights and the rows of bights so that they form rough sinusoidal lines which are bumpy along their length.

By way of example, the fibers used for a suitable pile carpet can be in the range of 5,700–12,000 denier. The fibers are relatively thick, as for example, a 1.5 mil thickness for 5,700 denier fiber, 2 mils thick for a 7,600 denier fiber, 2.6 mils thick for a 10,000 denier fiber and 3 mils thick for an approximately 12,000 denier fiber. A 2.6 mil thick, 10,000 denier fiber made of polypropylene is preferable. However, other plastics which are commercially available and have the necessary characteristics, such as nylon and some of the polyesters, can be used likewise. The plastic coating for the lower surface of the carpet base sheet may be of a commercially available urethane applied in the range of 30–40 ounces per square yard. In addition, the plastic coating may also be applied to the upper surface of the carpet base sheet.

A carpet having pile forming fibers of about a 1 inch height, that is, of roughly 2 inch long, U-bent strands, is applied to the carpet base sheet in the manner illustrated to form closely spaced tufts or piles along the length of the serpentine rows, with wider spaces between the rows. A fiber density of about 60 ounces per square yard base weight of carpet is preferable for use with a football playing surface.

Figure 2:
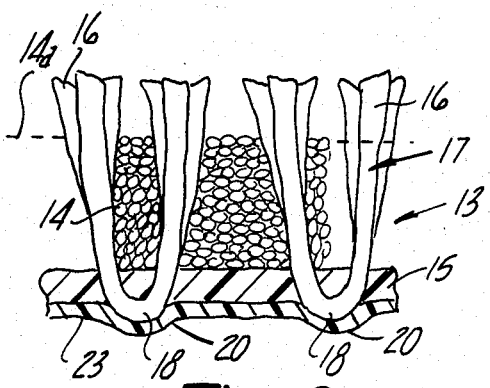
FIG. 2 is an enlarged, fragmentary cross sectional view taken in the direction of arrows 2—2 of FIG. 3.
Figure 3:
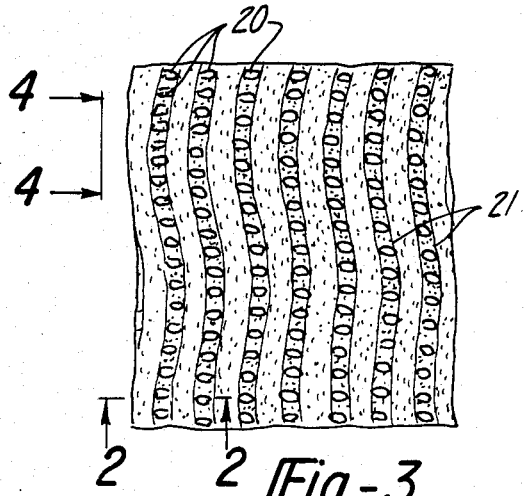
FIG. 3 is a plan view of the bottom surface of the pile carpet.
Figure 4:
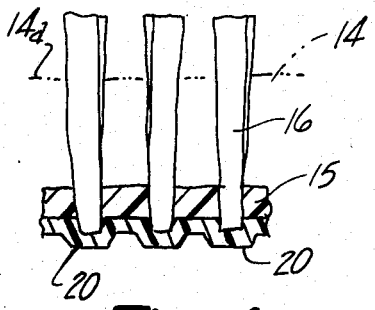
FIG. 4 is an enlarged, fragmentary cross sectional view taken in the direction of arrows 4—4 of FIG. 3.
Figure 5:
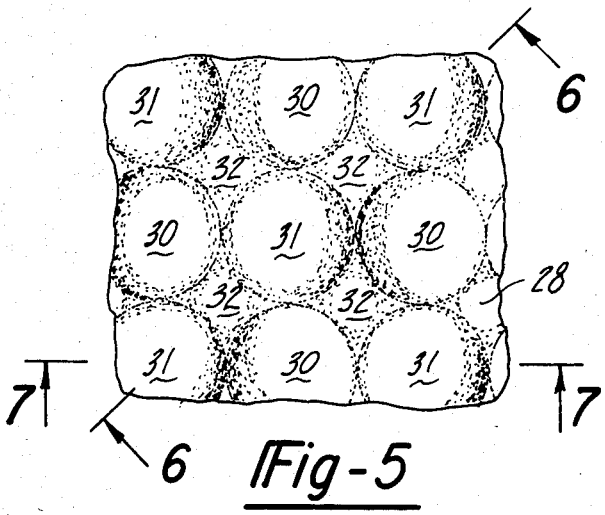
FIG. 5 is a plan view of the bottom surface of the underpad.

The sand-like granule in-fill may vary, depending upon the sport, but for hard running games such as football, a suitable fill comprises granules in the approximate range of 10–100 mesh, with a majority of the granules being in the 30–50 mesh range. As can be seen in FIGS. 2 and 4, since the spaces between the rows are about double the spaces between the bights in the direction of the rows, the sand in-fill between rows is about double the width of the sand between the adjacent bights in the other direction.

The underpad 12 is formed of particles of rubber-like material 25. Preferably this comprises reclaimed, buffing rubber, which is typically made of slivers of old automobile type tires. Such slivers vary in size considerably, but typically, for the purpose intended here, are in the range of $\frac{1}{4}$–$\frac{3}{4}$ inches long and 1/16–3/16 inches wide and thick. The slivers are irregularly shaped and they are closely packed and bonded together by a suitable adhesive, such as a commercially available polyurethane resin type of adhesive. The closely packed, irregular shaped slivers form a relatively dense mass, as for example, in the range of about 540 kilograms per cubic meter of density for a pad which is about 5/8 inch (about 1.7 mm) thick.

The underpad has a flat, rough upper surface 26 into which the welts 20 embed. These welts tend to mechanically and frictionally interlock with the particles that make up the upper surface of the underpad to prevent relative shifting even under loads directed substantially parallel to the underpad surface.

Figure 6:
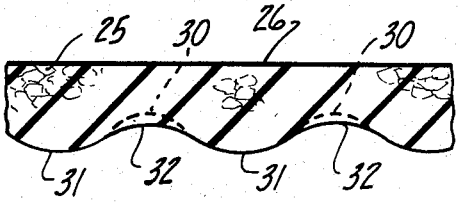
FIG. 6 is a cross sectional, fragmentary view of the underpad taken in the direction of arrows 6—6 of FIG. 5.
Figure 7:
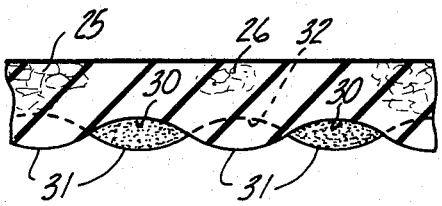
FIG. 7 is an enlarged, fragmentary cross sectional view of the underpad taken in the direction of arrows 7—7 of FIG. 5.

The lower surface 28 of the underpad is formed in an undulating, relief type configuration. That is, large (e.g., 1" diameter) rounded dimple-like depressions or indentations 30 are regularly and widely spaced apart in the lower surface. These depressions are surrounded by rounded hills 31, which extend downwardly, that are connected by rounded depressed valleys or ridges 32 that are not as deep as the dimple-like depressions. These are illustrated in FIGS. 6 and 7. Thus, the underpad lower suface tends to form downwardly opening cups which are interconnected by the spaces between the ridges and the overlapped surface of the stabilized base support. This cup-like configuration tends to interlock with the upper surface of the support base where the base is made of a sand or gravel surface. However, there tends to be air spaces or dome-like pockets formed within the lower surface of the underpad. These spaces are particularly found where the base support surface is of a monolithic, relatively smooth material, such as asphalt and the like.

The indentations in the lower surface of the underpad tends to provide springy chambers which resiliently yield and disperse impact loads caused either by hard running foot contact or by body contact with the surface.

The system described above gives good foot support during lateral or twisting movement of the player's feet upon the surface and avoids the player's feet binding in the grass-like fibers during twisting movements. Moreover, the resiliency and rapid recoverability of the surface makes it comfortable to the players yet provides a rebound characteristic which is fairly close to that of a natural grass or turf surface.

The surface is relatively easy to install and to maintain and has good drainage characteristics so that it is durable as well as sturdy enough to take the punishment of vigorous sports.

Having fully described an operative embodiment of this invention, I now claim:

1. A game playing surface, particularly for active running and body contact sports, such as football and the like, formed of a synthetic pile carpet positioned upon a stabilized, substantially flat base surface, comprising:

a relatively thick underpad laid upon the base surface, with said underpad formed of small size, irregularly shaped, closely packed resilient particles which are bonded together into a resilient, relatively dense mass;

the underpad having a substantially flat, rough upper surface and a lower surface with relatively large, relief-type, indentations that are widely and regularly spaced apart to form rounded substantially domed cavities whose open bottoms are covered by the overlapping portions of the base surface;

a pile carpet laid over the upper surface of the underpad and formed of substantially equal length, upwardly extending, relatively densely packed synthetic fibers fastened at their lower ends to a carpet base sheet so that the fibers provide a generally grassy appearance;

whereby the playing surface provides good foot support for lateral foot movements and resiliently absorbs and disperses foot and body impact forces.

2. A game playing surface as defined in claim 1, and including minute interstices between the particles so that the underpad mass is pervious to water for drainage.

3. A game playing surface as defined in claim 1, and with said underpad lower surface being formed with regularly and widely spaced apart, downwardly extending rounded top hills separated by rounded, indented ridges on the opposite sides of each indentation, and with the hills and ridges generally defining curves, and with the ridges being of lesser depth than the depth of the indentations, wherein the tops of the hills engage the base surface and the ridges are spaced upwardly from the base surface and the indentations are spaced even further upwardly from the base surface.

4. A game playing surface as defined in claim 3, and the particles being formed substantially or irregularly shaped, reclaimed rubber slivers that generally are between ¼ to ¾ inches long and between about 1/16–3/16 inches wide and thick, and there being interstices between particles so that the underpad mass is pervious to water for drainage.

5. A game playing surface as defined in claim 1 and with the fibers formed of double bent U-shaped strands whose legs form parallel fibers and with the bights of the bent fibers being looped through the carpet base sheet so that each bight extends downwardly through the carpet base sheet to form a short, downwardly protruding welt on the bottom surface of the carpet base sheet;

with the individual welts being aligned into numerous, parallel, spaced apart serpentine, generally sinusodal curved rows that extend along the carpet base bottom surface, and with the spacing between rows being greater than the spacing between adjacent individual welts in each row;

wherein the welts tend to dig into and frictionally interlock with the particles defining the upper surface of the underpad.

6. A game playing surface as defined in claim 5, wherein the bights forming each of said individual welts are arranged transversely of the rows in which they are located so that adjacent bights are generally parallel to, but offset relative to, each other.

7. A game playing surface as defined in claim 6, and including the lower surface and welts of the carpet base sheet being coated with a thin coating of a relatively high friction plastic material.

8. A game playing surface as defined in claim 6, and said fibers being roughly about 5,700 to 12,000 denier and a thickness of between about 1.5–3 mils.

9. A game playing surface as defined in claim 1, and including a coating of granules covering the carpet base sheet and substantially filling the interstices between the fibers for a substantial portion of the height of the fibers to near their upper free ends.

10. A game playing surface as defined in claim 9, wherein the granule covering is wider between adjacent rows than between adjacent welts to provide good support for lateral foot movements.

11. A game playing surface as defined in claim 9, wherein the granules are generally between about 10–100 mesh, with the majority being in the range of about 30–50 mesh.

12. A game playing surface particularly useful for active running and body contact sports such as football, formed of a synthetic pile carpet positioned upon a stabilized, substantially flat base surface, comprising:

a relatively thick underpad laid upon the base surface, with said underpad being formed of small size, irregularly shaped, closely packed resilient particles which are bonded together into a resilient mass;

the underpad having a substantially flat, rough, upper surface and a lower surface with relief type indentations in the shape of dimpled indentations surrounded by regularly spaced apart and separated rounded top downwardly extending hills that are separated from each other by recessed rounded ridges whose indentation depth is less than the indentations forming the dimples;

a pile carpet laid over the upper surface of the underpad and formed of substantially equal length, upwardly extending, relatively densely packed synthetic fibers fastened at their lower ends to a carpet base sheet;

a coating of granules covering the carpet base sheet and substantially filling the interstices between the fibers for a substantial portion of the height of the fibers;

wherein the tops of the hills formed on the bottom surface of the underpad engage the base surface, with the ridges spaced upwardly away from the base surface and the dimples spaced even further upwardly from the base surface to form substantially domed portions that are covered by the overlapping portions of the base surface; and wherein the playing surface provides good foot support for lateral foot movements and resiliently absorbs and disperses body and foot impact forces.

13. A game playing surface as defined in claim 12, and including said resilient particles being formed substantially of reclaimed rubber slivers or irregular shape that are generally of between about ¼ to ¾ inches long and between about 1/16–3/16 inches wide and thick, with minute interstices between particles so that the underpad mass is pervious to water for drainage.

* * * * *

UNITED STATES PATENT AND TRADEMARK OFFICE

CERTIFICATE OF CORRECTION

PATENT NO. : 4,637,942

DATED : January 20, 1987

INVENTOR(S) : Seymour A. Tomarin

It is certified that error appears in the above-identified patent and that said Letters Patent is hereby corrected as shown below:

In claim 3, line 6, after "defining" add --sinusodal--.

In claim 4, line 2, after "the" add --resilient-- and in the same line delete "or" and add --of--.

In claim 13, line 3, delete "or" and add --of--.

Signed and Sealed this

Twenty-first Day of April, 1987

*Attest:*

DONALD J. QUIGG

*Attesting Officer*

*Commissioner of Patents and Trademarks*